US011702768B2

(12) United States Patent
Fan et al.

(10) Patent No.: US 11,702,768 B2
(45) Date of Patent: Jul. 18, 2023

(54) PREPARATION METHOD OF SELF-CRIMPING ELASTIC COMBINED FILAMENT YARN FOR KNITTING

(71) Applicant: JIANGSU HENGLI CHEMICAL FIBRE CO., LTD., Wujiang (CN)

(72) Inventors: Hongwei Fan, Wujiang (CN); Fangming Tang, Wujiang (CN); Shanshui Wang, Wujiang (CN); Lixin Yin, Wujiang (CN); Lili Wang, Wujiang (CN)

(73) Assignee: JIANGSU HENGLI CHEMICAL FIBRE CO., LTD., Wujiang (CN)

( * ) Notice: Subject to any disclaimer, the term of this patent is extended or adjusted under 35 U.S.C. 154(b) by 0 days.

(21) Appl. No.: 17/787,951

(22) PCT Filed: Jun. 10, 2020

(86) PCT No.: PCT/CN2020/095343
§ 371 (c)(1),
(2) Date: Jun. 22, 2022

(87) PCT Pub. No.: WO2021/128749
PCT Pub. Date: Jul. 1, 2021

(65) Prior Publication Data

US 2023/0026102 A1 Jan. 26, 2023

(30) Foreign Application Priority Data

Dec. 24, 2019 (CN) ..... 201911350148.7

(51) Int. Cl.
*D01D 5/12* (2006.01)
*D01D 5/253* (2006.01)
(Continued)

(52) U.S. Cl.
CPC ..... *D01D 5/32* (2013.01); *D01D 5/08* (2013.01); *D01D 5/082* (2013.01); *D01D 5/22* (2013.01);
(Continued)

(58) Field of Classification Search
CPC ..... D01D 5/082; D01D 5/12; D01D 5/22; D01D 5/253; D01D 5/32; D01D 10/02;
(Continued)

(56) References Cited

U.S. PATENT DOCUMENTS 3,864,447 A * 2/1975 Sekiguchi ..... D01F 8/08 264/168 X
3,988,883 A * 11/1976 Sze ..... D01D 5/34 28/281 X
6,162,382 A 12/2000 Kent et al.

FOREIGN PATENT DOCUMENTS

CN 110088365 A 8/2019
CN 209652480 U 11/2019
(Continued)

OTHER PUBLICATIONS

GB/T 6506-2001, Test method for crimp contraction properties of textured filament yarns, Textile Institute of Industrial Standardization, 2001, pp. 1-5.

*Primary Examiner* — Leo B Tentoni
(74) *Attorney, Agent, or Firm* — Bayramoglu Law Offices LLC

(57) ABSTRACT

A preparation method of self-crimping elastic combined filament yarns for knitting is disclosed, wherein the combined filament yarns are extruded from the same spinneret; a first fiber-forming polymer melt is divided into two ways, one is directly extruded after distribution; and the other is extruded after distribution by side-by-side composite spinning together with a second fiber-forming polymer melt; the first fiber-forming polymer and the second fiber-forming
(Continued)

polymer are compatible or partially compatible; on the same spinneret, a ratio of the number of spinneret holes m for direct extrusion to the number of spinneret holes n for extrusion after distribution by side-by-side composite spinning is 1:(5-10); the self-crimping elastic combined filament yarns for knitting are prepared according to specific spinning processes, wherein the combined filament yarn mainly comprises a first fiber-forming polymer monofilament and a first/second fiber-forming polymer side-by-side composite monofilament; wherein the monofilament crimping directions are randomly distributed.

4 Claims, 1 Drawing Sheet

(51) Int. Cl.

| | |
|---|---|
| ***D01F 6/60*** | (2006.01) |
| ***D01F 6/62*** | (2006.01) |
| ***D02G 1/18*** | (2006.01) |
| ***D02G 1/20*** | (2006.01) |
| ***D02J 1/22*** | (2006.01) |
| ***D02J 13/00*** | (2006.01) |
| ***D01D 5/32*** | (2006.01) |
| ***D01D 5/08*** | (2006.01) |
| ***D01D 5/22*** | (2006.01) |
| ***D01D 10/02*** | (2006.01) |
| ***D01F 8/12*** | (2006.01) |
| ***D01F 8/14*** | (2006.01) |
| ***D02G 1/00*** | (2006.01) |
| ***D02G 3/32*** | (2006.01) |

(52) U.S. Cl.

CPC ..... *D01D 10/02* (2013.01); *D01F 8/12* (2013.01); *D01F 8/14* (2013.01); *D02G 1/004* (2013.01); *D02G 1/205* (2013.01); *D02G 3/326* (2013.01); *D02J 1/229* (2013.01); *D10B 2331/02* (2013.01); *D10B 2331/04* (2013.01); *D10B 2401/061* (2013.01)

(58) Field of Classification Search

CPC ..... D01F 6/60; D01F 6/62; D01F 8/12; D01F 8/14; D02G 1/004; D02G 1/18; D02G 1/20; D02G 1/205; D02G 3/326; D02J 1/22; D02J 1/229; D02J 13/00

USPC ..... 264/103, 168, 172.12, 172.14, 172.17, 264/172.18, 177.13, 210.8, 211.14, 264/211.17, 331.19, 331.21, 342 RE; 28/281

See application file for complete search history.

(56) References Cited

FOREIGN PATENT DOCUMENTS

| | | | |
|---|---|---|---|
| CN | 110983465 | A | 4/2020 |
| CN | 111058108 | A | 4/2020 |
| GB | 1130996 | A | 10/1968 |

* cited by examiner

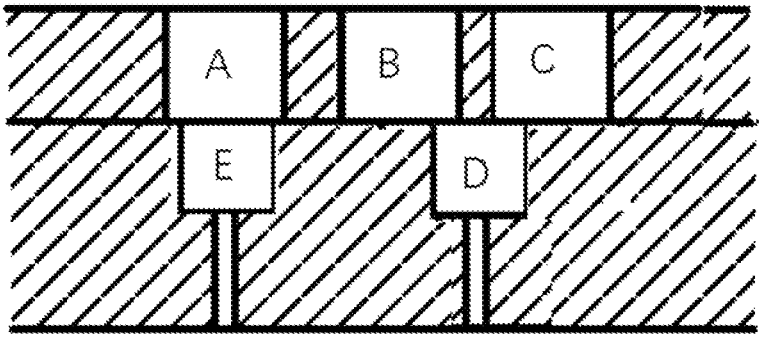
A
B
C
E
D

PREPARATION METHOD OF SELF-CRIMPING ELASTIC COMBINED FILAMENT YARN FOR KNITTING

CROSS REFERENCE TO THE RELATED APPLICATIONS

This application is the national phase entry of International Application No. PCT/CN2020/095343, filed on Jun. 10, 2020, which is based upon and claims priority to Chinese Patent Application No. 201911350148.7, filed on Dec. 24, 2019, the entire contents of which are incorporated herein by reference.

TECHNICAL FIELD

The present invention belongs to the field of polyester fiber, and more particularly, relates to a preparation method of self-crimping elastic combined filament yarns for knitting.

BACKGROUND

Crimp is an important indicator of fibers that affects textile processing and final product characteristics and application properties.

The side-by-side bicomponent composite fiber is important in the family of bicomponent composite fibers, which utilizes the difference in the heat shrinkage properties of two components to make the fiber bend away from the fiber axis, showing a permanent three-dimensional spiral crimp and obtaining a crimp similar to that of wool fibers. The crimp of the fiber does not require the texturing process of the crimp of ordinary thermoplastic fibers, avoiding the thermal damage of chemical fibers, therefore the fiber is usually called "self-crimping fiber", also known as three-dimensional crimp fiber, wherein the crimp is long-lasting, stable and elastic, which makes the fabric have better elasticity, fluffiness and coverage. By changing the component high-polymer properties, cross-sectional shape, component distribution, component ratio, spinning draft and heat-setting process parameters, the side-by-side bicomponent composite fiber with different properties can be obtained, which has high application value due to an advantage of designable performance, therefore it is favored and valued by the fiber manufacturing industry.

In the prior art, the three-dimensional spiral crimp of the bicomponent composite fiber enables to straighten under external stretching, and to return to the initial crimp well when the external force is removed. It is shown that in a bundle of PBT/PET bicomponent composite fibers, the crimp shapes have both relatively neat left and right spiral yarn segments and random crimp yarn segments, wherein the length and arrangement of each yarn segment are random overall. Due to the different fiber tilt state and mechanical response behavior of each crimp yarn segment, when using PBT/PET composite fibers for knitted fabrics, it will cause differences in the reflective effect and the uneven tension of the yarn, and the cloth surface will randomly form bumps or depressions, and the "uneven horizontal stripes" with random changes in light and shade will be found on the surface, that is the so-called "stripe unevenness"; this problem makes the bicomponent composite fiber unable to be applied in many kinds of knitted products, which seriously restricts the development and application of bicomponent composite fiber knitted fabrics.

Therefore, it is of great significance to develop a preparation method of self-crimping elastic combined filament yarns for knitting to avoid the random "strip unevenness".

SUMMARY

The primary object of the present invention is to provide a preparation method of self-crimping elastic combined filament yarns for knitting, so as to solve the problem of random "strip unevenness" in the application of the self-crimping elastic fiber for knitting in the prior art. The present invention "replaces" a part of first/second fiber-forming polymer side-by-side composite monofilaments with first fiber-forming polymer monofilaments, which breaks the neat left and right spiral shapes of the pure first/second fiber-forming polymer side-by-side composite fiber, and thus solves the problem of "strip unevenness" formed in the first/second fiber-forming polymer side-by-side composite fiber knitted fabric.

To this end, the technical schemes of the invention are as follows:

The method for preparing a self-crimping elastic combined filament yarn for knitting, comprising: extruding the self-crimping elastic combined filament yarn for knitting from the same spinneret;

wherein a first fiber-forming polymer melt is divided into two ways: one is directly extruded after distribution; and the other is extruded after distribution by side-by-side composite spinning together with a second fiber-forming polymer melt;

wherein the first fiber-forming polymer and the second fiber-forming polymer are compatible or partially compatible;

on the same spinneret, wherein a ratio of the number of spinneret holes m for direct extrusion to the number of spinneret holes n for extrusion after distribution by side-by-side composite spinning is 1:(5-10);

after extrusion, wherein the self-crimping elastic combined filament yarn for knitting is prepared according to specific spinning processes: a POY process, an FDY process, a POY-DTY process or a POY-DT process, wherein the POY process, the FDY process and the POY-DT process are followed by a relaxation heat treatment of the fiber.

Specifically, the present invention "replaces" by dividing the first fiber-forming polymer melt into two ways, one is directly extruded after distribution, and the other is extruded after distribution by side-by-side composite spinning together with the second fiber-forming polymer melt, accordingly, the number and positional relationship of distribution holes and guide holes are reasonably set to ensure the smooth division; the present invention controls the ratio of the number of spinneret holes m for direct extrusion to the number of spinneret holes n for extrusion after distribution by side-by-side composite spinning, to ensure that the proportion of the replaced part to the whole is appropriate, which can effectively solve the problem of "strip unevenness", and maintain the excellent properties of the first/second fiber-forming polymer side-by-side composite fiber; the present invention distributes all the spinneret holes in concentric circles, and controls the spinneret holes m as much as possible on the inner circle of the concentric circles, which ensures that the first fiber-forming polymer monofilament can be fully penetrated into the first/second fiber-forming polymer side-by-side composite fiber, and breaks the neat left and right spiral shapes of the pure first/second fiber-forming polymer side-by-side composite fiber; in the present invention, by reasonably setting the temperature of the spinning box III, the temperature of the first fiber-forming polymer melt spinning box I, and the temperature of the second fiber-forming polymer melt spinning box II, it can be compatible with the intrinsic viscosity of the first fiber-forming polymer melt and the intrinsic viscosity of the second fiber-forming polymer melt, to ensure that the apparent viscosities of the first fiber-forming polymer component and the second fiber-forming polymer component extruded from the spinneret are relatively close, thus ensuring the smooth spinning; the present invention uses the common single-component spinneret holes and the side-by-side composite spinneret holes, without adjusting the shape of the spinneret holes; according to specific spinning processes, the products prepared by the present invention have high crimp shrinkage, crimp stability, shrinkage elongation, and crimp elastic recovery rate, as well as good mechanical properties.

The principle of the present invention is as follows.

The self-crimping elastic combined filament yarn for knitting in the present invention is composed of the first fiber-forming polymer monofilament and the first/second fiber-forming polymer side-by-side composite monofilament, wherein two fiber-forming polymers have different heat shrinkage rates; after mixing the two polymers, their glass transition temperatures are related as follows: the glass transition temperature of the mixed polymer is between the polymer with a low glass transition temperature and the polymer with a high glass transition temperature, which shows that the two polymers with different heat shrinkage rates are compatible or partially compatible, and the existence of compatibility allows the polymers to be bonded together when they pass through the same spinneret (that is, the two fiber-forming polymer melts are extruded after distribution by side-by-side composite spinning together), wherein the bonding effect together with the aforementioned different heat shrinkage effects, makes two polymer fibers coming out of the same spinneret hole (that is, the first/second fiber-forming polymer side-by-side composite monofilament) to form a self-crimping shape after the relaxation heat treatment, so as to have elasticity.

While achieving the above-mentioned self-crimping elasticity, the present invention divides the first fiber-forming polymer melt into two ways: one is extruded after distribution by side-by-side composite spinning together with a second fiber-forming polymer melt (in order to achieve self-crimping elasticity); and the other is directly extruded after distribution to form the first fiber-forming polymer monofilament, wherein the ratio of the number of spinneret holes corresponding to two ways is 1:(5-10). The presence of the monofilament plays the role of breaking the pure first/second fiber-forming polymer side-by-side composite monofilament to form the neat left and right spiral shapes, so that the monofilament crimping directions of the prepared self-crimping elastic combined filament yarn for knitting are randomly distributed after the relaxation heat treatment; therefore, the surface of the knitted fabric woven from the self-crimping elastic combined filament yarn will not appear random "stripe unevenness".

Moreover, wherein the self-crimping elastic combined filament yarn for knitting has a three-dimensional spiral crimp in the longitudinal direction, wherein the three-dimensional crimp will make the fabric have good fluffiness, elasticity, extensibility and soft-hand feeling, while the irregular spiral crimp will make the fabric have good moisture conductivity.

The following preferred technology program is presented to give a detailed description for this invention.

In the method for preparing a self-crimping elastic combined filament yarn for knitting, wherein the ratio of the mass of the first fiber-forming polymer melt extruded from the spinneret hole n to the mass of the second fiber-forming polymer melt extruded from the spinneret hole n is 50:50, and the ratio of the equivalent diameter of the spinneret hole m to the equivalent diameter of the spinneret hole n is 1:1; wherein the first fiber-forming polymer and the second fiber-forming polymer are of the same materials with different viscosities, or of different materials, and between the polymers meeting the conditions, there must be differences in heat shrinkage, so that the fiber can form the self-crimping shape after relaxation heat treatment; wherein the materials of the first fiber-forming polymer and the second fiber-forming polymer are selected from polyester homopolymers (such as PET, PBT, PTT), polyester copolymers (such as PET-PBT, PET-PTT, PET-PEG, PET-PTMG, PBT-PTT), polyester modified products (such as CDP, ECDP, hydrophilic PET, dyed PET), polyamide homopolymers (such as PA6, PA66), polyamide copolymers (such as PA6-PBT, PA6-PTT) and polyamide modified products (such as PA6-11, PA6-PET).

wherein the spinneret hole m is a circular, oval, triangular, Y-shaped, cross-shaped, "8"-shaped, rectangular or in-line spinneret hole, and the spinneret hole n is a circular, oval or "8"-shaped spinneret hole.

wherein all the spinneret holes are distributed in concentric circles, and the spinneret holes on the same circle are all m or all n, while the spinneret holes on the outermost circle are all n, thus ensuring that the first fiber-forming polymer monofilament is mixed into the first/second fiber-forming polymer side-by-side composite monofilament, which plays the role of breaking the neat left and right spiral shapes; otherwise, if more first fiber-forming polymer monofilaments are distributed in the outermost circle, the inner first/second fiber-forming polymer side-by-side composite monofilaments will still have the neat left and right spiral shapes.

wherein the spinneret hole m comprises a guide hole E, a transition hole and a capillary micropore connected sequentially, the spinneret hole n comprises a guide hole D, a transition hole and a capillary micropore connected sequentially, the guide hole E is connected with a distribution hole A, and the guide hole D is connected with a distribution hole B and a distribution hole C at the same time; wherein the distribution hole A, the distribution hole B and the distribution hole C are located on the distribution plate in the spinning box III; wherein the division is to transport the first fiber-forming polymer melt through a spinning box I to the distribution hole A and the distribution hole B, while transport the second fiber-forming polymer melt through a spinning box II to the distribution hole C.

wherein the apparent viscosity of the first fiber-forming polymer melt differs from that of the second fiber-forming polymer melt by no more than 5% in the spinning components. In order to spin smoothly, it is necessary to ensure that the two components have the same flow state when extruded from the same spinneret, that is, the apparent viscosities of the two melts are close (for the same polymer, the greater the apparent viscosity, the worse the flow property); the apparent viscosity of the first fiber-forming polymer and the second fiber-forming polymer can be adjusted by temperature, in the present invention, by reasonably setting the temperature of the spinning box III, the temperature of the first fiber-forming polymer melt spinning box I, and the temperature of the second fiber-forming polymer melt spinning box II, it can be compatible with the intrinsic viscosity of the first fiber-forming polymer melt and the intrinsic viscosity of the second fiber-forming polymer melt, wherein the first fiber-forming polymer is melted at a high temperature and spun at a low temperature, and the second fiber-forming polymer is melted at a low temperature and spun at a high temperature, so as to reduce the degradation of the second fiber-forming polymer, although the temperature difference between the two components in the box is large, heat exchange occurs when the two components enter the same composite component, the temperature of the first fiber-forming polymer component decreasing and the temperature of the second fiber-forming polymer component increasing, so that the apparent viscosities of the two components extruded from the spinneret hole are close, thus ensuring the smooth spinning.

wherein the relaxation heat treatment has a temperature of 90-120° C., and a time of 20-30 min.

The self-crimping elastic combined filament yarns for knitting prepared by any one of the above preparation methods, is mainly composed of the first fiber-forming polymer monofilament and the first/second fiber-forming polymer side-by-side composite monofilament; wherein the monofilament crimping directions of the self-crimping elastic combined filament yarn for knitting are randomly distributed after the relaxation heat treatment, wherein the random distribution is a mathematical concept that each fiber has a different crimp shape than other fibers, thus the prepared fabric will not appear "stripe unevenness".

Benefits:

(1) The preparation method of self-crimping elastic combined filament yarn for knitting in the present invention, wherein the self-crimping elastic combined filament yarn for knitting is composed of the first fiber-forming polymer monofilament and the first/second fiber-forming polymer side-by-side composite monofilament, and cannot form a regular arrangement of spiral crimp, thus solving the problem of "stripe unevenness" formed in the first/second fiber-forming polymer side-by-side composite fiber knitted fabric;

(2) The preparation method of self-crimping elastic combined filament yarn for knitting in the present invention has a wide range of application and good promotion value.

BRIEF DESCRIPTION OF THE DRAWING

FIGURE is a schematic diagram of the structure of the spinneret in the present invention;

wherein A, B and C are mutually independent distribution holes, and D and E are mutually independent guide holes.

DETAILED DESCRIPTION OF THE EMBODIMENTS

Based on above mentioned method, the following embodiments are carried out for further demonstration in the present invention. It is to be understood that these embodiments are only intended to illustrate the invention and are not intended to limit the scope of the invention. In addition, it should be understood that after reading the contents described in the present invention, those technical personnel in this field can make various changes or modifications to the invention, and these equivalent forms also fall within the scope of the claims attached to the application.

The crimp shrinkage and crimp stability in the present invention are obtained by testing the tow by using GB6506-2001 "*Synthetic fiber—Test method for crimp contraction properties of textured filament yarns*";

The text methods of the shrinkage elongation (reflecting the degree of elasticity and crimp of textured filament yarns, wherein the fibers are subjected to a light load and then to a heavy load, and the ratio of the difference in length to the curl length is calculated for both loads) and the crimp elastic recovery rate are as follows:

Firstly, cut two fiber samples of about 50 cm in length, put them into 100° C. hot water for 30 minutes, take them out and dry them naturally, next intercept a sample of about 30 cm in length, wherein fix one end and load another end with a load of 0.0018 cN/dtex for 30 seconds, and mark it at 20 cm, that is, the initial length l1 of the sample; then load another end with a load of 0.09 cN/dtex for 30 seconds, and measure the position of the marked point, which is the length l2 of the sample under heavier load; finally remove the load and let the sample retract for 2 minutes, next add a load of 0.0018 cN/dtex for 30 seconds and measure the position of the marked point, which is the recovery length l3; the shrinkage elongation (CE) and the crimp elastic recovery rate (SR) are calculated as follows:

$$CE=(l_2-l_1)/l_1;$$

$$SR=(l_2-l_3)/(l_2-l_1).$$

Example 1

A self-crimping elastic combined filament yarns for knitting, prepared as follows:

(1) extruding the self-crimping elastic combined filament yarn for knitting from the same spinneret;

wherein a PET melt with an intrinsic viscosity of 0.57 dL/g is divided into two ways: one is directly extruded after distribution; and the other is extruded after distribution by side-by-side composite spinning together with a PTT melt with an intrinsic viscosity of 1.17 dL/g;

on the same spinneret, wherein a ratio of the number of circular spinneret holes m for direct extrusion to the number of circular spinneret holes n for extrusion after distribution by side-by-side composite spinning is 1:6, the ratio of the equivalent diameter of the spinneret hole m to the equivalent diameter of the spinneret hole n is 1:1, and the ratio of the mass of the PET melt extruded from the spinneret hole n to the mass of the PTT melt extruded from the spinneret hole n is 50:50; wherein all the spinneret holes are distributed in concentric circles, and the spinneret holes on the same circle are all m or all n, while the spinneret holes on the outermost circle are all n;

as shown in the FIGURE, wherein the spinneret hole m comprises a guide hole E, a transition hole and a capillary micropore connected sequentially, the spinneret hole n comprises a guide hole D, a transition hole and a capillary micropore connected sequentially, the guide hole E is connected with a distribution hole A, and the guide hole D is connected with a distribution hole B and a distribution hole C at the same time; wherein the distribution hole A, the distribution hole B and the distribution hole C are located on the distribution plate in the spinning box III; wherein the division is to transport the PET melt through a spinning box I to the distribution hole A and the distribution hole B, while transport the PTT melt through a spinning box II to the distribution hole C; wherein the temperature of the spinning box I is 276° C., the temperature of the spinning box II is 260° C., and the temperature of the spinning box III is 275° C.;

(2) after extrusion, the self-crimping elastic combined filament yarn for knitting is prepared by a POY process (obtaining a pre-oriented yarn), a DT stretching process (obtaining a drawn yarn), and then a relaxation heat treatment;

wherein the POY process has a cooling temperature of 24° C. and a winding speed of 2580 m/min; wherein the DT stretching process has a hot godet temperature of 85° C., a hot plate temperature of 120° C., and a multiplier of 1.6; wherein the relaxation heat treatment has a temperature of 109° C., and a time of 26 minutes;

wherein the self-crimping elastic combined filament yarn for knitting is composed of the PET monofilament and the PTT/PET side-by-side composite monofilament, and its monofilament crimping directions are randomly distributed; wherein the self-crimping elastic combined filament yarn for knitting comprises mechanical performance indices: a crimp shrinkage of 69%, a crimp stability of 94%, a shrinkage elongation of 111%, a crimp elastic recovery rate of 83%, a breaking strength of 3.2 cN/dtex, an elongation at break of 46.5%, and a total fineness of 130 dtex.

Example 2

A self-crimping elastic combined filament yarns for knitting, prepared as follows:

(1) extruding the self-crimping elastic combined filament yarn for knitting from the same spinneret;

wherein a PET melt with an intrinsic viscosity of 0.58 dL/g is divided into two ways: one is directly extruded after distribution; and the other is extruded after distribution by side-by-side composite spinning together with a PTT melt with an intrinsic viscosity of 1.15 dL/g;

on the same spinneret, wherein a ratio of the number of oval spinneret holes m for direct extrusion to the number of oval spinneret holes n for extrusion after distribution by side-by-side composite spinning is 1:10, the ratio of the equivalent diameter of the spinneret hole m to the equivalent diameter of the spinneret hole n is 1:1, and the ratio of the mass of the PET melt extruded from the spinneret hole n to the mass of the PTT melt extruded from the spinneret hole n is 50:50; wherein all the spinneret holes are distributed in concentric circles, and the spinneret holes on the same circle are all m or all n, while the spinneret holes on the outermost circle are all n;

wherein the spinneret hole m comprises a guide hole E, a transition hole and a capillary micropore connected sequentially, the spinneret hole n comprises a guide hole D, a transition hole and a capillary micropore connected sequentially, the guide hole E is connected with a distribution hole A, and the guide hole D is connected with a distribution hole B and a distribution hole C at the same time; wherein the distribution hole A, the distribution hole B and the distribution hole C are located on the distribution plate in the spinning box III; wherein the division is to transport the PET melt through a spinning box I to the distribution hole A and the distribution hole B, while transport the PTT melt through a spinning box II to the distribution hole C; wherein the temperature of the spinning box I is 280° C., the temperature of the spinning box II is 265° C., and the temperature of the spinning box III is 273° C.;

(2) after extrusion, the self-crimping elastic combined filament yarn for knitting is prepared by a POY process (obtaining a pre-oriented yarn), a DT stretching process (obtaining a drawn yarn), and then a relaxation heat treatment;

wherein the POY process has a cooling temperature of 25° C. and a winding speed of 2550 m/min; wherein the DT stretching process has a hot godet temperature of 85° C., a hot plate temperature of 124° C., and a multiplier of 1.8; wherein the relaxation heat treatment has a temperature of 115° C., and a time of 22 minutes;

wherein the self-crimping elastic combined filament yarn for knitting is composed of the PET monofilament and the PTT/PET side-by-side composite monofilament, and its monofilament crimping directions are randomly distributed; wherein the self-crimping elastic combined filament yarn for knitting comprises mechanical performance indices: a crimp shrinkage of 66%, a crimp stability of 93%, a shrinkage elongation of 112%, a crimp elastic recovery rate of 84%, a breaking strength of 3.1 cN/dtex, an elongation at break of 48.3%, and a total fineness of 115 dtex.

Example 3

A self-crimping elastic combined filament yarns for knitting, prepared as follows:

(1) extruding the self-crimping elastic combined filament yarn for knitting from the same spinneret;

wherein a PET melt with an intrinsic viscosity of 0.55 dL/g is divided into two ways: one is directly extruded after distribution; and the other is extruded after distribution by side-by-side composite spinning together with a PTT melt with an intrinsic viscosity of 1.2 dL/g;

on the same spinneret, wherein a ratio of the number of triangular spinneret holes m for direct extrusion to the number of "8"-shaped spinneret holes n for extrusion after distribution by side-by-side composite spinning is 1:5, the ratio of the equivalent diameter of the spinneret hole m to the equivalent diameter of the spinneret hole n is 1:1, and the ratio of the mass of the PET melt extruded from the spinneret hole n to the mass of the PTT melt extruded from the spinneret hole n is 50:50; wherein all the spinneret holes are distributed in concentric circles, and the spinneret holes on the same circle are all m or all n, while the spinneret holes on the outermost circle are all n;

wherein the spinneret hole m comprises a guide hole E, a transition hole and a capillary micropore connected sequentially, the spinneret hole n comprises a guide hole D, a transition hole and a capillary micropore connected sequentially, the guide hole E is connected with a distribution hole A, and the guide hole D is connected with a distribution hole B and a distribution hole C at the same time; wherein the distribution hole A, the distribution hole B and the distribution hole C are located on the distribution plate in the spinning box III; wherein the division is to transport the PET melt through a spinning box I to the distribution hole A and the distribution hole B, while transport the PTT melt through a spinning box II to the distribution hole C; wherein the temperature of the spinning box I is 278° C., the temperature of the spinning box II is 264° C., and the temperature of the spinning box III is 275° C.;

(2) after extrusion, the self-crimping elastic combined filament yarn for knitting is prepared by a POY process (obtaining a pre-oriented yarn), a DT stretching process (obtaining a drawn yarn), and then a relaxation heat treatment;

wherein the POY process has a cooling temperature of 24° C. and a winding speed of 2640 m/min; wherein the DT stretching process has a hot godet temperature of 88° C., a hot plate temperature of 126° C., and a multiplier of 1.8; wherein the relaxation heat treatment has a temperature of 120° C., and a time of 20 minutes;

wherein the self-crimping elastic combined filament yarn for knitting is composed of the PET monofilament and the PTT/PET side-by-side composite monofilament, and its monofilament crimping directions are randomly distributed; wherein the self-crimping elastic combined filament yarn for knitting comprises mechanical performance indices: a crimp shrinkage of 69%, a crimp stability of 93.8%, a shrinkage elongation of 113%, a crimp elastic recovery rate of 84%, a breaking strength of 3.3 cN/dtex, an elongation at break of 49.2%, and a total fineness of 125 dtex.

Example 4

A self-crimping elastic combined filament yarns for knitting, prepared as follows:

(1) extruding the self-crimping elastic combined filament yarn for knitting from the same spinneret;

wherein a high-viscosity PET melt with an intrinsic viscosity of 0.75 dL/g is divided into two ways: one is directly extruded after distribution; and the other is extruded after distribution by side-by-side composite spinning together with a low-viscosity PET melt with an intrinsic viscosity of 0.5 dL/g;

wherein a ratio of the number of circular spinneret holes m for direct extrusion to the number of circular spinneret holes n for extrusion after distribution by side-by-side composite spinning is 1:8; wherein the ratio of the mass of the high-viscosity PET melt extruded from the spinneret hole n to the mass of the low-viscosity PET melt extruded from the spinneret hole n is 50:50; wherein the ratio of the equivalent diameter of the spinneret hole m to the equivalent diameter of the spinneret hole n is 1:1;

wherein all the spinneret holes are distributed in concentric circles, and the spinneret holes on the same circle are all m or all n, while the spinneret holes on the outermost circle are all n;

wherein the spinneret hole m comprises a guide hole E, a transition hole and a capillary micropore connected sequentially, the spinneret hole n comprises a guide hole D, a transition hole and a capillary micropore connected sequentially, the guide hole E is connected with a distribution hole A, and the guide hole D is connected with a distribution hole B and a distribution hole C at the same time; wherein the distribution hole A, the distribution hole B and the distribution hole C are located on the distribution plate in the spinning box III; wherein the division is to transport the high-viscosity PET melt through a spinning box I to the distribution hole A and the distribution hole B, while transport the low-viscosity PET melt through a spinning box II to the distribution hole C; wherein the temperature of the spinning box I is 286° C., the temperature of the spinning box II is 275° C., and the temperature of the spinning box III is 283° C.;

(2) after extrusion, the self-crimping elastic combined filament yarn for knitting is prepared by an FDY process (obtaining a fully drawn yarn), and then a relaxation heat treatment;

wherein the FDY process involves technological parameters: a cooling temperature of 25° C., an interlacing pressure of 0.2 MPa, a godet roller 1 speed of 2300 m/min, a godet roller 1 temperature of 85° C., a godet roller 2 speed of 3560 m/min, a godet roller 2 temperature of 150° C., and a winding speed of 3460 m/min; wherein the relaxation heat treatment has a temperature of 104° C., and a time of 30 minutes;

wherein the self-crimping elastic combined filament yarn for knitting is composed of the high-viscosity PET monofilament and the high-viscosity PET/low-viscosity PET side-by-side composite monofilament, and its monofilament crimping directions are randomly distributed; wherein the self-crimping elastic combined filament yarn for knitting comprises mechanical performance indices: a crimp shrinkage of 53%, a crimp stability of 87%, a shrinkage elongation of 98%, a crimp elastic recovery rate of 96%, a breaking strength of 3.1 cN/dtex, an elongation at break of 45%, and a total fineness of 130 dtex. The self-crimping elastic combined filament yarn for knitting prepared above is made into the knitted fabric, which is tested for strip unevenness, and the fabric has a D value of 0.51.

Example 5

A self-crimping elastic combined filament yarns for knitting, prepared as follows:

(1) extruding the self-crimping elastic combined filament yarn for knitting from the same spinneret;

wherein a high-viscosity PET melt with an intrinsic viscosity of 0.73 dL/g is divided into two ways: one is directly extruded after distribution; and the other is extruded after distribution by side-by-side composite spinning together with a low-viscosity PET melt with an intrinsic viscosity of 0.54 dL/g;

wherein a ratio of the number of oval spinneret holes m for direct extrusion to the number of circular spinneret holes n for extrusion after distribution by side-by-side composite spinning is 1:6; wherein the ratio of the mass of the high-viscosity PET melt extruded from the spinneret hole n to the mass of the low-viscosity PET melt extruded from the spinneret hole n is 50:50; wherein the ratio of the equivalent diameter of the spinneret hole m to the equivalent diameter of the spinneret hole n is 1:1;

wherein all the spinneret holes are distributed in concentric circles, and the spinneret holes on the same circle are all m or all n, while the spinneret holes on the outermost circle are all n;

wherein the spinneret hole m comprises a guide hole E, a transition hole and a capillary micropore connected sequentially, the spinneret hole n comprises a guide hole D, a transition hole and a capillary micropore connected sequentially, the guide hole E is connected with a distribution hole A, and the guide hole D is connected with a distribution hole B and a distribution hole C at the same time; wherein the distribution hole A, the distribution hole B and the distribution hole C are located on the distribution plate in the spinning box III; wherein the division is to transport the high-viscosity PET melt through a spinning box I to the distribution hole A and the distribution hole B, while transport the low-viscosity PET melt through a spinning box II to the distribution hole C; wherein the temperature of the spinning box I is 282° C., the temperature of the spinning box II is 271° C., and the temperature of the spinning box III is 278° C.;

(2) after extrusion, the self-crimping elastic combined filament yarn for knitting is prepared by an FDY process (obtaining a fully drawn yarn), and then a relaxation heat treatment;

wherein the FDY process involves technological parameters: a cooling temperature of 20° C., an interlacing pressure of 0.25 MPa, a godet roller 1 speed of 2350 m/min, a godet roller 1 temperature of 95° C., a godet roller 2 speed of 3660 m/min, a godet roller 2 temperature of 160° C., and a winding speed of 3530 m/min; wherein the relaxation heat treatment has a temperature of 103° C., and a time of 28 minutes;

wherein the self-crimping elastic combined filament yarn for knitting is composed of the high-viscosity PET monofilament and the high-viscosity PET/low-viscosity PET side-by-side composite monofilament, and its monofilament crimping directions are randomly distributed; wherein the self-crimping elastic combined filament yarn for knitting comprises mechanical performance indices: a crimp shrinkage of 52.8%, a crimp stability of 85%, a shrinkage elongation of 95%, a crimp elastic recovery rate of 95.4%, a breaking strength of 3.1 cN/dtex, an elongation at break of 44.2%, and a total fineness of 115 dtex. The self-crimping elastic combined filament yarn for knitting prepared above is made into the knitted fabric, which is tested for strip unevenness, and the fabric has a D value of 0.39.

Example 6

A self-crimping elastic combined filament yarns for knitting, prepared as follows:

(1) extruding the self-crimping elastic combined filament yarn for knitting from the same spinneret;

wherein a high-viscosity PET melt with an intrinsic viscosity of 0.73 dL/g is divided into two ways: one is directly extruded after distribution; and the other is extruded after distribution by side-by-side composite spinning together with a low-viscosity PET melt with an intrinsic viscosity of 0.55 dL/g;

wherein a ratio of the number of triangular spinneret holes m for direct extrusion to the number of circular spinneret holes n for extrusion after distribution by side-by-side composite spinning is 1:8; wherein the ratio of the mass of the high-viscosity PET melt extruded from the spinneret hole n to the mass of the low-viscosity PET melt extruded from the spinneret hole n is 50:50; wherein the ratio of the equivalent diameter of the spinneret hole m to the equivalent diameter of the spinneret hole n is 1:1;

wherein all the spinneret holes are distributed in concentric circles, and the spinneret holes on the same circle are all m or all n, while the spinneret holes on the outermost circle are all n;

wherein the spinneret hole m comprises a guide hole E, a transition hole and a capillary micropore connected sequentially, the spinneret hole n comprises a guide hole D, a transition hole and a capillary micropore connected sequentially, the guide hole E is connected with a distribution hole A, and the guide hole D is connected with a distribution hole B and a distribution hole C at the same time; wherein the distribution hole A, the distribution hole B and the distribution hole C are located on the distribution plate in the spinning box III; wherein the division is to transport the high-viscosity PET melt through a spinning box I to the distribution hole A and the distribution hole B, while transport the low-viscosity PET melt through a spinning box II to the distribution hole C; wherein the temperature of the spinning box I is 283° C., the temperature of the spinning box II is 275° C., and the temperature of the spinning box III is 279° C.;

(2) after extrusion, the self-crimping elastic combined filament yarn for knitting is prepared by an FDY process (obtaining a fully drawn yarn), and then a relaxation heat treatment;

wherein the FDY process involves technological parameters: a cooling temperature of 21° C., an interlacing pressure of 0.23 MPa, a godet roller 1 speed of 2300 m/min, a godet roller 1 temperature of 86° C., a godet roller 2 speed of 3500 m/min, a godet roller 2 temperature of 151° C., and a winding speed of 3430 m/min; wherein the relaxation heat treatment has a temperature of 120° C., and a time of 29 minutes;

wherein the self-crimping elastic combined filament yarn for knitting is composed of the high-viscosity PET monofilament and the high-viscosity PET/low-viscosity PET side-by-side composite monofilament, and its monofilament crimping directions are randomly distributed; wherein the self-crimping elastic combined filament yarn for knitting comprises mechanical performance indices: a crimp shrinkage of 52%, a crimp stability of 85.5%, a shrinkage elongation of 96%, a crimp elastic recovery rate of 95.1%, a breaking strength of 3 cN/dtex, an elongation at break of 46%, and a total fineness of 125 dtex. The self-crimping elastic combined filament yarn for knitting prepared above is made into the knitted fabric, which is tested for strip unevenness, and the fabric has a D value of 0.68.

Example 7

A method for preparing a self-crimping elastic combined filament yarns for knitting, comprising:

(1) extruding the self-crimping elastic combined filament yarn for knitting from the same spinneret;

wherein a PBT melt with an intrinsic viscosity of 0.97 dL/g is divided into two ways: one is directly extruded after distribution; and the other is extruded after distribution by side-by-side composite spinning together with a PTT melt with an intrinsic viscosity of 1.03 dL/g; wherein the ratio of the mass of the PBT melt extruded from the spinneret hole n to the mass of the PTT melt extruded from the spinneret hole n is 50:50, and the ratio of the equivalent diameter of the spinneret hole m to the equivalent diameter of the spinneret hole n is 1:1; wherein a ratio of the number of circular spinneret holes m for direct extrusion to the number of circular spinneret holes n for extrusion after distribution by side-by-side composite spinning is 1:6;

wherein the spinneret hole m comprises a guide hole E, a transition hole and a capillary micropore connected sequentially, the spinneret hole n comprises a guide hole D, a transition hole and a capillary micropore connected sequentially, the guide hole E is connected with a distribution hole A, and the guide hole D is connected with a distribution hole B and a distribution hole C at the same time; wherein the distribution hole A, the distribution hole B and the distribution hole C are located on the distribution plate in the spinning box III; wherein the division is to transport the PBT melt through a spinning box I to the distribution hole A and the distribution hole B, while transport the PTT melt through a spinning box II to the distribution hole C; wherein the temperature of the spinning box I is 269° C., the temperature of the spinning box II is 272° C., and the temperature of the spinning box III is 279° C.; wherein all the spinneret holes are distributed in concentric circles, and the spinneret holes on the same circle are all m or all n, while the spinneret holes on the outermost circle are all n;

(2) after extrusion, the self-crimping elastic combined filament yarn for knitting is prepared by a POY-DTY process; wherein the POY process has a cooling temperature of 24° C., an interlacing pressure of 0.2 MPa and a winding speed of 2800 m/min; wherein the DTY process has a spinning speed of 750 m/min, a setting over-feed ratio of 3.5%, a winding over-feed ratio of 3%, a first heating chamber temperature of 200° C., a second heating chamber temperature of 173° C., a stretching multiplier of 1.5, a D/Y value of 1.9, and an interlacing pressure 0.05 MPa;

wherein the self-crimping elastic combined filament yarn for knitting is composed of the PBT monofilament and the PBT/PTT side-by-side composite monofilament, and its monofilament crimping directions are randomly distributed;

wherein the prepared PBT/PET bicomponent elastic yarn with random distribution of monofilament crimping directions comprises mechanical performance indices: a crimp shrinkage of 65%, a crimp stability of 85%, a shrinkage elongation of 108%, a crimp elastic recovery rate of 98%, a breaking strength of 27 cN/dtex, an elongation at break of 49%, and a total fineness of 200 dtex.

Comparison 1

A method for preparing a self-crimping elastic combined filament yarn for knitting comprises steps basically the same as those in example 7, except for the spinning process, wherein the PBT melt is not divided into two ways, but all together with the PTT melt and extruded after distribution by side-by-side composite spinning together; therefore, the prepared self-crimping elastic combined filament yarns for knitting does not have the PTT monofilament.

The self-crimping elastic combined filament yarns for knitting prepared by the comparison 1 and example 7, are separately used in plain knitted fabrics knitted on a seamlessly formed circular knitting machine to test the stripe unevenness of the two plain knitted fabrics, the testing process of each plain knitted fabric is as follows: first, the plain knitted fabric image is captured and converted into a grayscale image, and then the parameter D will be calculated after the first processing and the second processing of the grayscale image, using the parameter D characterizes the degree of strip unevenness, where the grayscale image includes the strip shade area, the high gray value area of the non-strip shade area and the low gray value area of the non-strip shade area; the first processing is to change the pixel points in the high gray value area of the non-strip shade area in the grayscale image into pure white points; the second processing is to change the pixel points in the low gray value area of the non-strip shade area in the grayscale image into pure white points; the parameter D is calculated by the formula: $D=\Sigma B/A$, wherein $\Sigma B$ represents the number of pixel points in the grayscale image when the gray value is 0, and A represents the total number of pixel points in the grayscale image.

The test results are as follows: the D value of the plain knitted fabric made of the self-crimping elastic combined filament yarns for knitting in example 7 is 0.7%; the D value of the plain knitted fabric made of the self-crimping elastic combined filament yarns for knitting in comparison 1 is 16.8%; it is shown that the strip unevenness of the plain knitted fabric made of the self-crimping elastic combined filament yarns for knitting in example 7 has been reduced. This is because some PBT/PTT side-by-side composite monofilaments are replaced by a part of PBT monofilaments in example 7, thus breaking the neat left and right spiral shapes of the pure PBT/PTT bicomponent composite fibers; so that the crimp shape of each PBT/PTT side-by-side composite monofilament is different from other fibers, and the stripe unevenness will not appear on the fabric surface after making the plain knitted fabric; however, the plain knitted fabric made of the self-crimping elastic combined filament yarns for knitting in comparison 1, will show uneven stripes on the fabric surface due to the neat left and right spiral shapes of the fibers.

Example 8

A method for preparing a self-crimping elastic combined filament yarns for knitting, comprising:

(1) extruding the self-crimping elastic combined filament yarn for knitting from the same spinneret;

wherein a PBT melt with an intrinsic viscosity of 0.95 dL/g is divided into two ways: one is directly extruded after distribution; and the other is extruded after distribution by side-by-side composite spinning together with a PTT melt with an intrinsic viscosity of 1.05 dL/g; wherein the ratio of the mass of the PBT melt extruded from the spinneret hole n to the mass of the PTT melt extruded from the spinneret hole n is 50:50, and the ratio of the equivalent diameter of the spinneret hole m to the equivalent diameter of the spinneret hole n is 1:1; wherein a ratio of the number of circular spinneret holes m for direct extrusion to the number of oval spinneret holes n for extrusion after distribution by side-by-side composite spinning is 1:7;

among them, wherein the spinneret hole m comprises a guide hole E, a transition hole and a capillary micropore connected sequentially, the spinneret hole n comprises a guide hole D, a transition hole and a capillary micropore connected sequentially, the guide hole E is connected with a distribution hole A, and the guide hole D is connected with a distribution hole B and a distribution hole C at the same time; wherein the distribution hole A, the distribution hole B and the distribution hole C are located on the distribution plate in the spinning box III; wherein the division is to transport the PBT melt through a spinning box I to the distribution hole A and the distribution hole B, while transport the PTT melt through a spinning box II to the distribution hole C; wherein the temperature of the spinning box I is 272° C., the temperature of the spinning box II is 275° C., and the temperature of the spinning box III is 276° C.; wherein all the spinneret holes are distributed in concentric circles, and the spinneret holes on the same circle are all m or all n, while the spinneret holes on the outermost circle are all n;

(2) after extrusion, the self-crimping elastic combined filament yarn for knitting is prepared by a POY-DTY process; wherein the POY process has a cooling temperature of 25° C., an interlacing pressure of 0.21 MPa and a winding speed of 3000 m/min; wherein the DTY process has a spinning speed of 800 m/min, a setting over-feed ratio of 3.8%, a winding over-feed ratio of 3.3%, a first heating chamber temperature of 220° C., a second heating chamber temperature of 180° C., a stretching multiplier of 1.9, a D/Y value of 2.2, and an interlacing pressure 1.5 MPa;

wherein the self-crimping elastic combined filament yarn for knitting is composed of the PBT monofilament and the PBT/PTT side-by-side composite monofilament, and its monofilament crimping directions are randomly distributed;

wherein the prepared PBT/PET bicomponent elastic yarn with random distribution of monofilament crimping directions comprises mechanical performance indices: a crimp shrinkage of 61%, a crimp stability of 86%, a shrinkage elongation of 108%, a crimp elastic recovery rate of 97%, a breaking strength of 25 cN/dtex, an elongation at break of 55%, and a total fineness of 105 dtex.

Example 9

A method for preparing a self-crimping elastic combined filament yarns for knitting, comprising:

(1) extruding the self-crimping elastic combined filament yarn for knitting from the same spinneret;

wherein a PBT melt with an intrinsic viscosity of 0.98 dL/g is divided into two ways: one is directly extruded after distribution; and the other is extruded after distribution by side-by-side composite spinning together with a PTT melt with an intrinsic viscosity of 1.1 dL/g; wherein the ratio of the mass of the PBT melt extruded from the spinneret hole n to the mass of the PTT melt extruded from the spinneret hole n is 50:50, and the ratio of the equivalent diameter of the spinneret hole m to the equivalent diameter of the spinneret hole n is 1:1; wherein a ratio of the number of circular spinneret holes m for direct extrusion to the number of "8"-shaped spinneret holes n for extrusion after distribution by side-by-side composite spinning is 1:5;

among them, wherein the spinneret hole m comprises a guide hole E, a transition hole and a capillary micropore connected sequentially, the spinneret hole n comprises a guide hole D, a transition hole and a capillary micropore connected sequentially, the guide hole E is connected with a distribution hole A, and the guide hole D is connected with a distribution hole B and a distribution hole C at the same time; wherein the distribution hole A, the distribution hole B and the distribution hole C are located on the distribution plate in the spinning box III; wherein the division is to transport the PBT melt through a spinning box I to the distribution hole A and the distribution hole B, while transport the PTT melt through a spinning box II to the distribution hole C; wherein the temperature of the spinning box I is 269° C., the temperature of the spinning box II is 276° C., and the temperature of the spinning box III is 276° C.; wherein all the spinneret holes are distributed in concentric circles, and the spinneret holes on the same circle are all m or all n, while the spinneret holes on the outermost circle are all n;

(2) after extrusion, the self-crimping elastic combined filament yarn for knitting is prepared by a POY-DTY process; wherein the POY process has a cooling temperature of 24° C., an interlacing pressure of 0.22 MPa and a winding speed of 3100 m/min; wherein the DTY process has a spinning speed of 770 m/min, a setting over-feed ratio of 4.5%, a winding over-feed ratio of 3.9%, a first heating chamber temperature of 178° C., a second heating chamber temperature of 130° C., a stretching multiplier of 1.5, a D/Y value of 1.8, and an interlacing pressure 1.4 MPa;

wherein the self-crimping elastic combined filament yarn for knitting is composed of the PBT monofilament and the PBT/PTT side-by-side composite monofilament, and its monofilament crimping directions are randomly distributed;

wherein the prepared PBT/PET bicomponent elastic yarn with random distribution of monofilament crimping directions comprises mechanical performance indices: a crimp shrinkage of 65%, a crimp stability of 87%, a shrinkage elongation of 110%, a crimp elastic recovery rate of 98%, a breaking strength of 26 cN/dtex, an elongation at break of 50%, and a total fineness of 120 dtex.

Example 10

A method for preparing a self-crimping elastic combined filament yarns for knitting, comprising:

(1) extruding the self-crimping elastic combined filament yarn for knitting from the same spinneret;

wherein a PET melt with an intrinsic viscosity of 0.5 dL/g is divided into two ways: one is directly extruded after distribution; and the other is extruded after distribution by side-by-side composite spinning together with a PET-PA6 copolymer melt with an intrinsic viscosity of 0.65 dL/g; wherein the ratio of the mass of the PET melt extruded from the spinneret hole n to the mass of the PET-PA6 copolymer melt extruded from the spinneret hole n is 50:50;

wherein a ratio of the number of circular spinneret holes m for direct extrusion to the number of circular spinneret holes n for extrusion after distribution by side-by-side composite spinning is 1:7; wherein the ratio of the equivalent diameter of the spinneret hole m to the equivalent diameter of the spinneret hole n is 1:1; wherein all the spinneret holes are distributed in concentric circles, and the spinneret holes on the same circle are all m or all n, while the spinneret holes on the outermost circle are all n;

wherein the spinneret hole m comprises a guide hole E, a transition hole and a capillary micropore connected sequentially, the spinneret hole n comprises a guide hole D, a transition hole and a capillary micropore connected sequentially, the guide hole E is connected with a distribution hole A, and the guide hole D is connected with a distribution hole B and a distribution hole C at the same time; wherein the distribution hole A, the distribution hole B and the distribution hole C are located on the distribution plate in the spinning box III; wherein the division is to transport the PET melt through a spinning box I to the distribution hole A and the distribution hole B, while transport the PET-PA6 copolymer melt through a spinning box II to the distribution hole C;

(2) after extrusion, the self-crimping elastic combined filament yarn for knitting is prepared by an FDY process (obtaining a fully drawn yarn), and then a relaxation heat treatment;

wherein the FDY process involves technological parameters: a temperature of the spinning box I of 282° C., a temperature of the spinning box II of 274° C., a temperature of the spinning box III of 280° C., a cooling temperature of 25° C., an interlacing pressure of 0.2 MPa, a godet roller 1 speed of 2300 m/min, a godet roller 1 temperature of 70° C., a godet roller 2 speed of 3560 m/min, a godet roller 2 temperature of 125° C., and a winding speed of 3480 m/min; wherein the relaxation heat treatment has a temperature of 104° C., and a time of 30 minutes;

wherein the self-crimping elastic combined filament yarn for knitting is composed of the PET monofilament and the PET/PET-PA6 copolymer side-by-side composite monofilament, and its monofilament crimping directions are randomly distributed; wherein the self-crimping elastic combined filament yarn for knitting comprises mechanical performance indices: a crimp shrinkage of 53%, a crimp stability of 87%, a shrinkage elongation of 90%, a crimp elastic recovery rate of 93%, a breaking strength of 3.4 cN/dtex, an elongation at break of 45%, and a total fineness of 130 dtex.

The self-crimping elastic combined filament yarn for knitting prepared above is made into the knitted fabric, which is tested for strip unevenness, and the fabric has a D value of 0.54%.

Example 11

A method for preparing a self-crimping elastic combined filament yarns for knitting, comprising:

(1) extruding the self-crimping elastic combined filament yarn for knitting from the same spinneret;

wherein a PET melt with an intrinsic viscosity of 0.56 dL/g is divided into two ways: one is directly extruded after distribution; and the other is extruded after distribution by side-by-side composite spinning together with a PET-PA6 copolymer melt with an intrinsic viscosity of 0.63 dL/g; wherein the ratio of the mass of the PET melt extruded from the spinneret hole n to the mass of the PET-PA6 copolymer melt extruded from the spinneret hole n is 50:50;

wherein a ratio of the number of oval spinneret holes m for direct extrusion to the number of circular spinneret holes n for extrusion after distribution by side-by-side composite spinning is 1:6; wherein the ratio of the equivalent diameter of the spinneret hole m to the equivalent diameter of the spinneret hole n is 1:1; wherein all the spinneret holes are distributed in concentric circles, and the spinneret holes on the same circle are all m or all n, while the spinneret holes on the outermost circle are all n;

wherein the spinneret hole m comprises a guide hole E, a transition hole and a capillary micropore connected sequentially, the spinneret hole n comprises a guide hole D, a transition hole and a capillary micropore connected sequentially, the guide hole E is connected with a distribution hole A, and the guide hole D is connected with a distribution hole B and a distribution hole C at the same time; wherein the distribution hole A, the distribution hole B and the distribution hole C are located on the distribution plate in the spinning box III; wherein the division is to transport the PET melt through a spinning box I to the distribution hole A and the distribution hole B, while transport the PET-PA6 copolymer melt through a spinning box II to the distribution hole C;

(2) after extrusion, the self-crimping elastic combined filament yarn for knitting is prepared by an FDY process (obtaining a fully drawn yarn), and then a relaxation heat treatment;

wherein the FDY process involves technological parameters: a temperature of the spinning box I of 280° C., a temperature of the spinning box II of 271° C., a temperature of the spinning box III of 270° C., a cooling temperature of 20° C., an interlacing pressure of 0.25 MPa, a godet roller 1 speed of 2350 m/min, a godet roller 1 temperature of 80° C., a godet roller 2 speed of 3660 m/min, a godet roller 2 temperature of 130° C., and a winding speed of 3570 m/min; wherein the relaxation heat treatment has a temperature of 103° C., and a time of 28 minutes;

wherein the self-crimping elastic combined filament yarn for knitting is composed of the PET monofilament and the PET/PET-PA6 copolymer side-by-side composite monofilament, and its monofilament crimping directions are randomly distributed; wherein the self-crimping elastic combined filament yarn for knitting comprises mechanical performance indices: a crimp shrinkage of 52.8%, a crimp stability of 85%, a shrinkage elongation of 89%, a crimp elastic recovery rate of 91.4%, a breaking strength of 3.15 cN/dtex, an elongation at break of 46%, and a total fineness of 115 dtex.

The self-crimping elastic combined filament yarn for knitting prepared above is made into the knitted fabric, which is tested for strip unevenness, and the fabric has a D value of 0.82%.

Example 12

A method for preparing a self-crimping elastic combined filament yarns for knitting, comprising:

(1) extruding the self-crimping elastic combined filament yarn for knitting from the same spinneret;

wherein a PET melt with an intrinsic viscosity of 0.58 dL/g is divided into two ways: one is directly extruded after distribution; and the other is extruded after distribution by side-by-side composite spinning together with a PET-PA6 copolymer melt with an intrinsic viscosity of 0.63 dL/g; wherein the ratio of the mass of the PET melt extruded from the spinneret hole n to the mass of the PET-PA6 copolymer melt extruded from the spinneret hole n is 50:50;

wherein a ratio of the number of triangular spinneret holes m for direct extrusion to the number of circular spinneret holes n for extrusion after distribution by side-by-side composite spinning is 1:7; wherein the ratio of the equivalent diameter of the spinneret hole m to the equivalent diameter of the spinneret hole n is 1:1; wherein all the spinneret holes are distributed in concentric circles, and the spinneret holes on the same circle are all m or all n, while the spinneret holes on the outermost circle are all n;

wherein the spinneret hole m comprises a guide hole E, a transition hole and a capillary micropore connected sequentially, the spinneret hole n comprises a guide hole D, a transition hole and a capillary micropore connected sequentially, the guide hole E is connected with a distribution hole A, and the guide hole D is connected with a distribution hole B and a distribution hole C at the same time; wherein the distribution hole A, the distribution hole B and the distribution hole C are located on the distribution plate in the spinning box III; wherein the division is to transport the PET melt through a spinning box I to the distribution hole A and the distribution hole B, while transport the PET-PA6 copolymer melt through a spinning box II to the distribution hole C;

(2) after extrusion, the self-crimping elastic combined filament yarn for knitting is prepared by an FDY process (obtaining a fully drawn yarn), and then a relaxation heat treatment;

wherein the FDY process involves technological parameters: a temperature of the spinning box I of 280° C., a temperature of the spinning box II of 274° C., a temperature of the spinning box III of 276° C., a cooling temperature of 21° C., an interlacing pressure of 0.23 MPa, a godet roller 1 speed of 2300 m/min, a godet roller 1 temperature of 76° C., a godet roller 2 speed of 3500 m/min, a godet roller 2 temperature of 127° C., and a winding speed of 3430 m/min; wherein the relaxation heat treatment has a temperature of 120° C., and a time of 29 minutes;

wherein the self-crimping elastic combined filament yarn for knitting is composed of the PET monofilament and the PET/PET-PA6 copolymer side-by-side composite monofilament, and its monofilament crimping directions are randomly distributed; wherein the self-crimping elastic combined filament yarn for knitting comprises mechanical performance indices: a crimp shrinkage of 52%, a crimp stability of 85.5%, a shrinkage elongation of 88%, a crimp elastic recovery rate of 91.1%, a breaking strength of 3 cN/dtex, an elongation at break of 51.2%, and a total fineness of 125 dtex.

The self-crimping elastic combined filament yarn for knitting prepared above is made into the knitted fabric, which is tested for strip unevenness, and the fabric has a D value of 0.38%.

What is claimed is:

1. A method for preparing a self-crimping elastic combined filament yarn for knitting, comprising: extruding the self-crimping elastic combined filament yarn for knitting from a same spinneret;

wherein a first fiber-forming polymer melt is divided into two ways: one is directly extruded after distribution; and the other is extruded after distribution by side-by-side composite spinning together with a second fiber-forming polymer melt;

wherein the first fiber-forming polymer melt and the second fiber-forming polymer melt are compatible or partially compatible;

on the same spinneret, wherein a ratio of a number of spinneret holes for direct extrusion to a number of spinneret holes for extrusion after the distribution by side-by-side composite spinning is 1:(5-10); wherein all the spinneret holes are distributed in concentric circles, and the spinneret holes on a same circle are all the spinneret holes for the direct extrusion or all the spinneret holes for the extrusion after the distribution by side-by-side composite spinning, while the spinneret holes on an outermost circle are all the spinneret holes for the extrusion after the distribution by side-by-side composite spinning;

wherein each of the spinneret holes for the direct extrusion comprises a first guide hole, a first transition hole and a first capillary micropore connected sequentially, each of the spinneret holes for the extrusion after the distribution by side-by-side composite spinning comprises a second guide hole, a second transition hole and a second capillary micropore connected sequentially, the first guide hole is connected with a first distribution hole, and the second guide hole is connected with a second distribution hole and a third distribution hole at the same time; wherein the first distribution hole, the second distribution hole and the third distribution hole are located on a distribution plate in a third spinning box; wherein a division is to transport the first fiber-forming polymer melt through a first spinning box to the first distribution hole and the second distribution hole, while transport the second fiber-forming polymer melt through a second spinning box to the third distribution hole;

after the extrusion, wherein the self-crimping elastic combined filament yarn for knitting is prepared according to specific spinning processes: a POY process, an FDY process, a POY-DTY process or a POY-DT process, wherein the POY process, the FDY process and the POY-DT process are followed by a relaxation heat treatment of a fiber, and monofilament crimping directions are randomly distributed after the relaxation heat treatment; wherein the relaxation heat treatment has a temperature of 90-120° C. and a time of 20-30 min.

2. The method of claim 1, wherein a ratio of a mass of the first fiber-forming polymer melt extruded from the spinneret holes for the extrusion after the distribution by side-by-side composite spinning to a mass of the second fiber-forming polymer melt extruded from the spinneret holes for the extrusion after the distribution by side-by-side composite spinning is 50:50, and a ratio of an equivalent diameter of the spinneret holes for the direct extrusion to an equivalent diameter of the spinneret holes for the extrusion after the distribution by side-by-side composite spinning is 1:1; wherein the first fiber-forming polymer melt and the second fiber-forming polymer melt are of same materials with different viscosities, or of different materials; wherein the materials of the first fiber-forming polymer melt and the second fiber-forming polymer melt are selected from polyester or polyamide, wherein the polyester is PET, PBT, or PTT, and the polyamide is PA6.

3. The method of claim 1, wherein each of the spinneret holes for the direct extrusion is a circular, oval, triangular, Y-shaped, cross-shaped, "8"-shaped, rectangular or in-line spinneret hole, and each of the spinneret holes for the extrusion after the distribution by side-by-side composite spinning is a circular, oval or "8"-shaped spinneret hole.

4. The method of claim 1, wherein an apparent viscosity of the first fiber-forming polymer melt differs from an apparent viscosity of the second fiber-forming polymer melt by no more than 5% in spinning components.

* * * * *